US007364414B2

(12) United States Patent
Kuramoto et al.

(10) Patent No.: US 7,364,414 B2
(45) Date of Patent: Apr. 29, 2008

(54) FLUID PUMP SYSTEM

(75) Inventors: Satoru Kuramoto, Kariya (JP); Shinya Yamamoto, Kariya (JP); Nobuaki Hoshino, Kariya (JP); Ryosuke Koshizaka, Kariya (JP); Mamoru Kuwahara, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 688 days.

(21) Appl. No.: 10/655,451

(22) Filed: Sep. 3, 2003

(65) Prior Publication Data

US 2004/0109781 A1 Jun. 10, 2004

(30) Foreign Application Priority Data

Sep. 6, 2002 (JP) ..... 2002-261371

(51) Int. Cl.
*F04B 39/00* (2006.01)

(52) U.S. Cl. ..... 417/572

(58) Field of Classification Search ..... 417/572, 417/40; 418/85, 201.1; 415/146
See application file for complete search history.

(56) References Cited

U.S. PATENT DOCUMENTS

| | | | | | |
|---|---|---|---|---|---|
| 2,677,944 | A | * | 5/1954 | Ruff | 418/85 |
| 2,906,448 | A | * | 9/1959 | Lorenz | 418/85 |
| 4,174,196 | A | * | 11/1979 | Mori et al. | 418/85 |
| 4,600,361 | A | * | 7/1986 | Bianco | 415/146 |
| 4,672,937 | A | * | 6/1987 | Fales et al. | 417/40 |
| 4,982,812 | A | | 1/1991 | Hwang | |
| 5,443,644 | A | * | 8/1995 | Ozawa | 418/201.1 |

FOREIGN PATENT DOCUMENTS

| | | |
|---|---|---|
| DE | 3240714 | 5/1984 |
| EP | 1201927 A2 | 5/2002 |
| JP | 2002-130170 | 5/2002 |

* cited by examiner

*Primary Examiner*—Anthony Stashick
*Assistant Examiner*—Vikansha Dwivedi
(74) *Attorney, Agent, or Firm*—Knoble Yoshida & Dunleavy, LLC

(57) ABSTRACT

A fluid pump system has a cover, a fluid pump and a conduit. An inside of the cover is divided into a main chamber and a sub chamber. The fluid pump is accommodated in the main chamber. The conduit extends from the fluid pump to an outside of the cover through the sub chamber.

15 Claims, 4 Drawing Sheets

FLUID PUMP SYSTEM

BACKGROUND OF THE INVENTION

The present invention relates to a fluid pump system that accommodates a fluid pump in its cover and that delivers a conduit from the fluid pump outside the cover.

For example, in a semiconductor manufacturing process, a vacuum pump exhausts process gas and the like, which are used in a semiconductor processing device. It is not preferable that the process gas, such as arsine and silane series gas, is released into the atmosphere. Then, the process gas leaked from the vacuum pump is prevented from being released into the atmosphere in such a manner that the vacuum pump is accommodated in a cover.

When the vacuum pump is accommodated in the cover as described above, a conduit connected to the vacuum pump is delivered from the inside of the cover to the outside of the cover. Accordingly, a clearance between the conduit and the cover may be a passage through which the process gas in the cover leaks outside the cover. In a prior art, a seal member is arranged at the clearance between the cover and the conduit for shutting communication between the inside and outside of the cover through the clearance. For example, the above structure is disclosed in the page 5 and FIG. 7 in Unexamined Japanese Patent Publication No. 2002-130170.

An unwanted feature is that the structure disclosed in the Unexamined Japanese Patent Publication No. 2002-130170 directly delivers the conduit from the inside of the cover, which is a space for accommodating the vacuum pump, to the outside of the cover so that the above described single seal member serves to shut communication between the inside and outside of the cover through the clearance between the cover and the conduit. Accordingly, when the seal member degrades, the process gas in the cover possibly leaks outside the cover through the clearance between the cover and the conduit. Therefore, there is a need for a fluid pump system that efficiently prevents the fluid from leaking outside the cover.

SUMMARY OF THE INVENTION

In order to solve the above and other problems, according to a first aspect of the current invention, a fluid pump system including a cover, an inside of which is divided into a main chamber and a sub chamber; a fluid pump accommodated in the main chamber; a conduit extending from the fluid pump to an outside of the cover through the sub chamber; and a collecting means for collecting fluid that is leaked from the fluid pump and/or the conduit in the main chamber and the sub chamber in the cover; wherein the main chamber and the sub chamber are defined by a partition wall in the cover, the partition wall forming: a through hole through which the conduit extends; and a communication hole interconnecting the sub chamber and the main chamber in addition to the through hole, the collecting means collecting the fluid in the sub chamber through the communication hole and the main chamber.

According to a second aspect of the current invention, a fluid pump system including a cover, an inside of which is divided into a main chamber and a sub chamber; a fluid pump accommodated in the main chamber; a conduit extending from the fluid pump to an outside of the cover through the sub chamber for exhausting fluid of the fluid pump; a collecting means for collecting the fluid that is leaked from the fluid pump and/or the conduit into the main chamber and the sub chamber in the cover; wherein the fluid pump treats gas, the collecting means including a suction means for sucking the gas in the cover; and an introducing passage provided at a clearance between the conduit and the cover for introducing outside air into the cover.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A preferred embodiment of the present invention will now be described with reference to FIGS. 1 through 3. The present invention is applied to a fluid pump system for exhausting fluid in a process chamber in a semiconductor manufacturing process in the preferred embodiment. The left side and the right side respectively correspond to the front side and the rear side of the fluid pump system in FIGS. 1 through 3.

Figure 1:
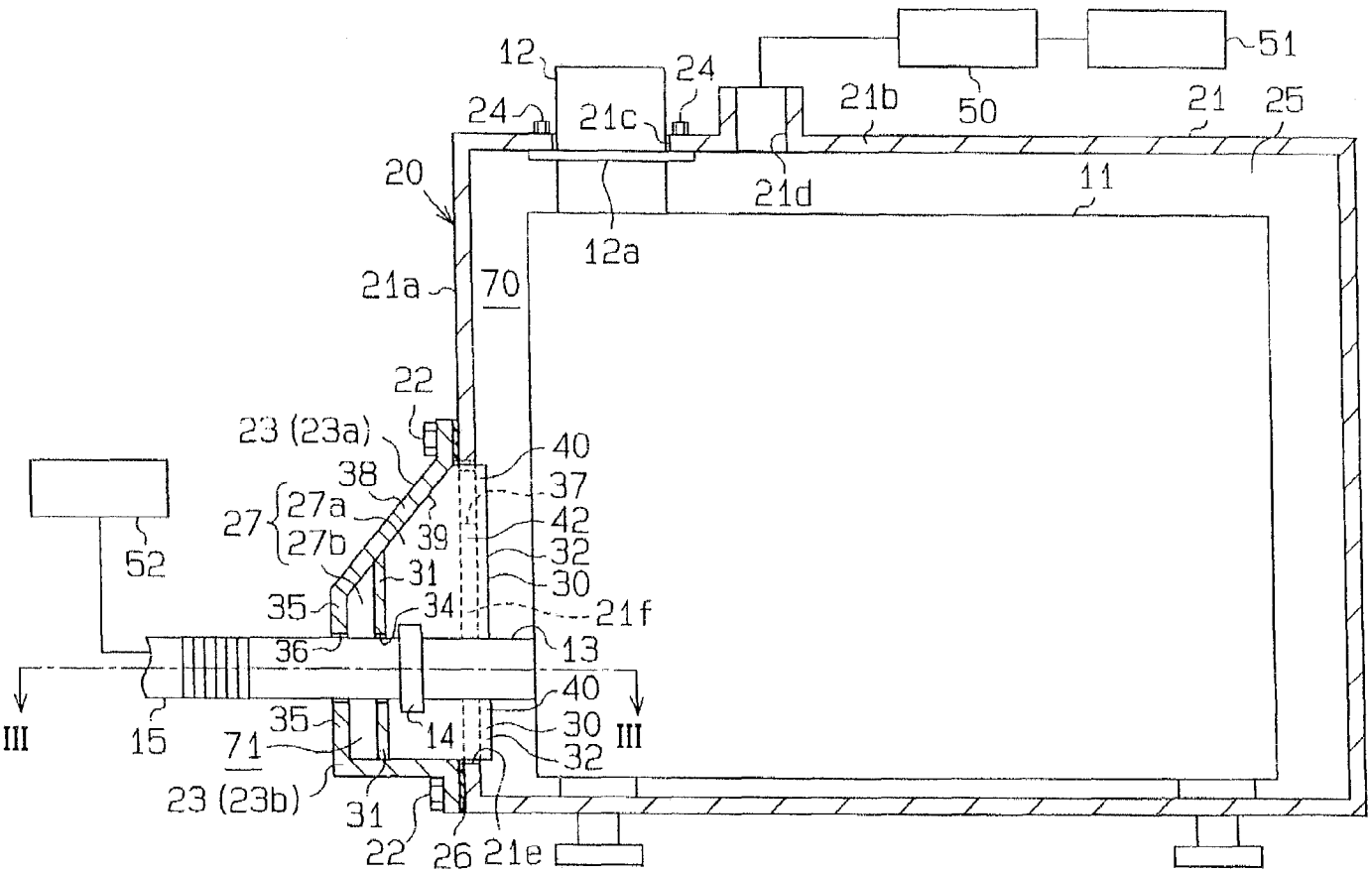
FIG. 1 is a longitudinal cross-sectional view of a fluid pump system according to a preferred embodiment of the present invention.

Now referring to FIG. 1, the diagram illustrates a longitudinal cross-sectional view of the fluid pump system according to the preferred embodiment of the present invention. A vacuum pump or a fluid pump 11 of the fluid pump system is accommodated in a cover 20. A multi-stage roots pump is employed as the vacuum pump 11. The vacuum pump 11 vacuums process gas in the semiconductor manufacturing process. The process gas, for example, includes toxic gas, such as alsine ($AsH_3$), and flammable gas, such as silane series gas (monosilane ($SiH_4$) and disilane ($Si_2H_6$)).

The vacuum pump 11 is connected to a process chamber or a target space vacuumed (not shown) through a suction pipe 12, which extends from the upper end surface of the vacuum pump 11. Also, the vacuum pump 11 is connected to an exhaust pipe or a first conduit component 13, which extends from the front end surface of the vacuum pump 11, and is further connected to an exhaust gas treatment apparatus 52 outside the cover 20 through a flexible hose or a second conduit component 15, which is connected to the exhaust pipe 13 by a coupling 14. The vacuum pump 11 vacuums the process gas from the target space vacuumed through the suction pipe 12 and exhausts to the exhaust gas treatment apparatus 52 through the exhaust pipe 13 and the flexible hose 15.

The exhaust pipe 13 and the flexible hose 15 serve as a conduit for introducing exhaust gas of the vacuum pump 11 to the exhaust gas treatment apparatus 52. Now referring to FIG. 3, the diagram illustrates a partially enlarged cross-sectional view that is taken along the line III-III in FIG. 1. The exhaust pipe 13 and the flexible hose 15 are fixedly connected to each other in such a manner that the annular coupling 14 couples respective flanges 13*a*, 15*a* of the exhaust pipe 13 and the flexible hose 15, which are formed at respective connecting portions thereof. The coupling 14 includes two coupling members 14*a*, 14*b*. Each of the coupling members 14*a*, 14*b* is fitted to sandwich the respective exhaust pipe 13 and the flexible hose 15 by radially approaching from the outsides of the respective flanges 13*a*, 15*a*. Then, the coupling members 14*a*, 14*b* are fastened with each other by a thumbscrew. The flanges 13*a*, 15*a* are in contact with each other through a ring member 17 and an annular seal member 18, which is fitted around the outer periphery of the ring member 17.

Figure 2:
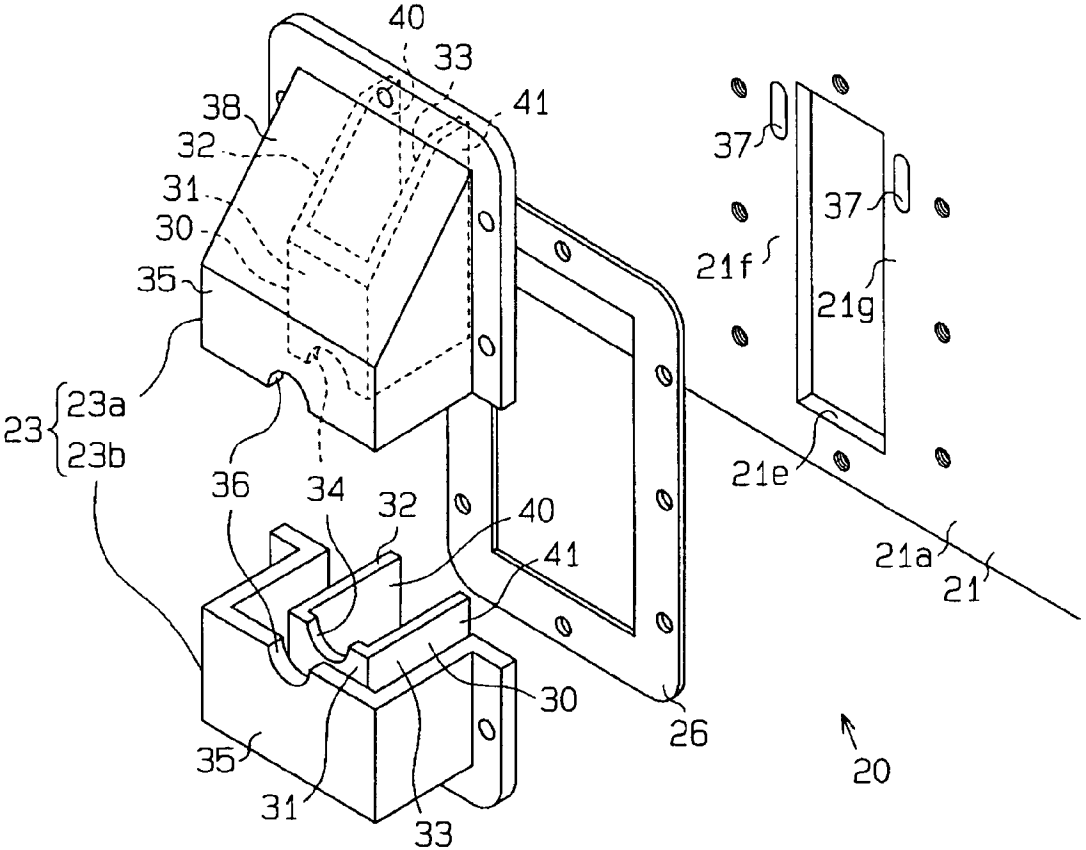
FIG. 2 is an enlarged exploded perspective view of a sub cover of the fluid pump system in a state where a vacuum pump, an exhaust pipe, a coupling and a flexible hose are removed according to the preferred embodiment of the present invention.

Now referring to FIGS. 1 and 2, FIG. 2 illustrates an enlarged exploded perspective view of a sub cover 23 of the fluid pump system in a state where the vacuum pump 11, the exhaust pipe 13, the coupling 14 and the flexible hose 15 are removed according to the preferred embodiment of the present invention. The cover 20 includes a cover body 21 and the sub cover 23. The cover body 21 accommodates the vacuum pump 11. The sub cover 23 is fixedly connected to an outer surface 21*a* of the front end wall of the cover body 21 by a bolt 22 through a packing 26.

An upper end wall 21*b* of the cover body 21 forms a hole 21*c* for inserting the suction pipe 12 of the vacuum pump 11 as illustrated in FIG. 1. The distal end side of the suction pipe 12 protrudes outside the cover 20 through the hole 21*c*. A flange 12*a* radially extends from the suction pipe 12 and is fixedly connected to the cover body 21 by bolts 24 so as to seal a clearance between the hole 21*c* and the suction pipe 12. Incidentally, a seal member (not shown) is interposed between the flange 12*a* and the upper end wall 21*b* of the cover body 21 and prevents communication between the inside and outside of the cover 20 through the clearance between the hole 21*c* and the suction pipe 12.

The upper end wall 21*b* of the cover body 21 forms a suction port 21*d* near the hole 21*c* for connecting a fluid suction apparatus or a suction means 50. The fluid suction apparatus 50 is another fluid pump other than the vacuum pump 11. The fluid suction apparatus 50 sucks gas in an inner space 25 of the cover body 21 through the suction port 21*d*. The gas sucked by the fluid suction apparatus 50 is sent to another exhaust gas treatment apparatus 51 other than the above described exhaust gas treatment apparatus 52.

Figure 3:
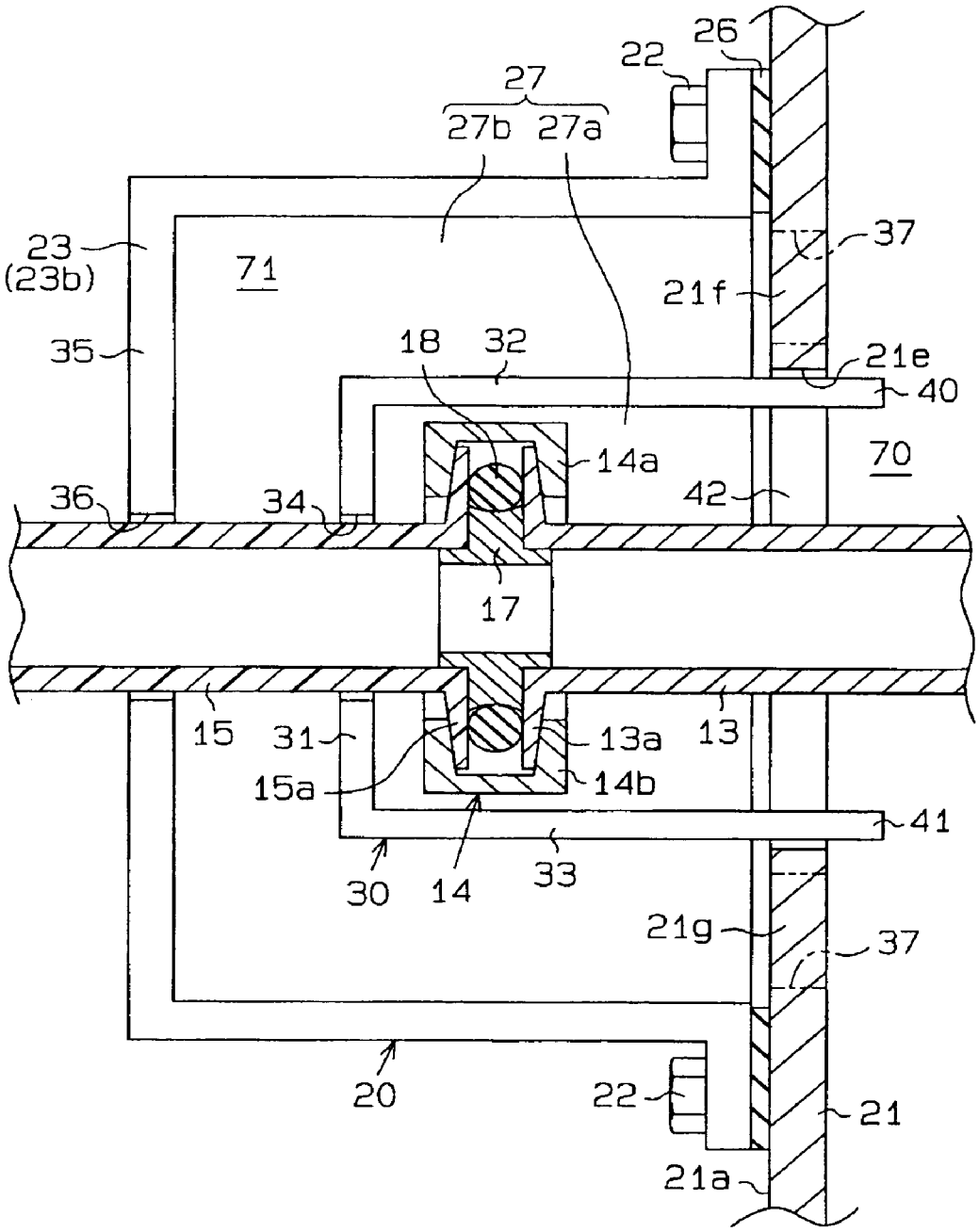
FIG. 3 is a partially enlarged cross-sectional view that is taken along the line III-III in FIG. 1.

As shown in FIGS. 1 through 3, the sub cover 23 defines an inner space 27 outside the cover body 21. In other words, the inner space 27 of the sub cover 23 does not go into the inner space 25 of the cover body 21 in which the vacuum pump 11 is arranged.

The inner space 27 of the sub cover 23 is divided by a first partition wall 30, which is fixedly connected to the sub cover 23, and defines a first inner space 27*a* and a second inner space 27*b*. The first partition wall 30 includes a front partition wall 31, a right side partition wall 32 and a left side partition wall 33. The front partition wall 31 includes wall surfaces respectively facing forward and rearward. The right side partition wall 32 extends rearward from the right end of the front partition wall 31. The left side partition wall 33 extends from the left end of the front partition wall 31. A space surrounded by the partition walls 31 through 33 in the inner space 27 is the first inner space 27*a*, while a space other than the first inner space 27*a* in the inner space 27 of the sub cover 23 is the second inner space 27*b*.

The front partition wall 31 forms a through hole 34, through which the flexible hose 15 extends. The through hole 34 is a little larger in diameter than the flexible hose 15 so as to insert the flexible hose 15. A front end wall 35 of the sub cover 23 that partially constitutes the outer wall of the cover 20 forms a hole 36 on the front side relative to the through hole 34, through which the flexible hose 15 extends. The hole 36 is a little larger in diameter than the flexible hose 15 so as to insert the flexible hose 15, as well as the through hole 34.

Incidentally, a clearance between the hole 36 of the sub cover 23 and the flexible hose 15 functions as an introducing passage for introducing outside air (atmosphere) into the cover 20 (strictly, the second inner space 27*b* of the sub cover 23) in response to suction action of the fluid suction apparatus 50. Then, the introducing passage and the fluid suction apparatus 50 functions as a collecting means for collecting the process gas that is leaked in the cover 20 from the connecting portion between the exhaust pipe 13 and the flexible hose 15 and from the vacuum pump 11.

The inner space 25 of the cover body 21 communicates with the first inner space 27*a* of the sub cover 23 through a passage 21*e*, which is formed in the cover body 21. The exhaust pipe 13 extends into the first inner space 27*a* of the sub cover 23 from the vacuum pump 11 through the passage 21*e* of the cover body 21. The distal end of the exhaust pipe 13 that connects the flexible hose 15 is provided in the first inner space 27*a*.

The flexible hose 15 extends into the first inner space 27*a* through the hole 36 of the front end wall 35 of the sub cover 23 and the through hole 34, that is, from the outside of the cover 20 into the first inner space 27*a* through the second inner space 27*b* of the sub cover 23. In other words, the end of the flexible hose 15 that is opposite to the connecting portion with the exhaust pipe 13 is delivered from the first inner space 27*a* to the outside of the cover 20 through the through hole 34, the second inner space 27*b* and the hole 36. The connecting portion between the exhaust pipe 13 and the flexible hose 15 is provided near the through hole 34 in the first inner space 27*a* of the sub cover 23.

In the preferred embodiment, the inner space 25 of the cover body 21 and the first inner space 27*a* of the sub cover 23, in which the first inner space 27*a* communicates with the inner space 25 through the passage 21*e*, constitute a main chamber 70 for accommodating the vacuum pump 11 and the exhaust pipe 13 in the cover 20. Namely, the inner space 25 of the cover body 21 for accommodating the vacuum pump 11 mostly constitutes the main chamber 70, while the second inner space 27*b* of the sub cover 23 is separated from the main chamber 70 and constitutes a sub chamber 71, which communicates with the main chamber 70 through the through hole 34.

A right side second partition wall 21*f* is a part of the front end wall of the cover body 21 and faces the second inner space 27*b* of the sub cover 23 on the right side relative to the right side partition wall 32. The right side second partition wall 21*f* separates the second inner space 27*b* from the inner space 25 of the cover body 21. Likewise, a left side second partition wall 21*g* is a part of the front end wall of the cover body 21 and faces the second inner space 27*b* of the sub cover 23 on the left side relative to the left side partition wall 33. The left side second partition wall 21*g* also separates the second inner space 27*b* from the inner space 25 of the cover body 21. Communication holes 37 are respectively formed in the second partition walls 21*f*, 21*g* that interconnect the second inner space 27*b* of the sub cover 23 and the inner space 25 of the cover body 21. Each of the communication holes 37 forms an oblong shape and extends in the vertical direction. Incidentally, the partition walls 21*f*, 21*g* and 30 constitute a partition wall for defining the main chamber 70 and the sub chamber 71.

An upper wall 38 partially forms the outer wall of the sub cover 23. The upper wall 38 includes an inner wall surface or a guide wall surface 39 that extends from the front end wall 35 adjacent to the hole 36 toward the second partition walls 21*f*, 21*g* adjacent to the respective communication holes 37.

Rear ends 40, 41 (baffle boards) of the right and left side partition walls 32, 33 of the sub cover 23 respectively protrude into the inner space 25 through the passage 21*e* of the cover body 21. Namely, the partition walls 32, 33 are partially inserted through the passage 21*e*. The rear ends 40, 41 of the respective partition walls 32, 33 are respectively arranged between the opening of the through hole 34 on the side of the main chamber 70 and the openings of the communication holes 37 on the side of the main chamber 70 and also protrude into the main chamber 70. Incidentally, in the passage 21*e*, a space between the facing partition walls 32, 33 is a communication passage 42 that interconnects the first inner space 27*a* of the sub cover 23 and the inner space 25 of the cover body 21.

In the preferred embodiment, the sub cover 23 includes upper and lower components, and each of the upper and lower components includes a half of the through hole 34 and a half of the hole 36. The upper and lower components are connected to each other. In other words, the sub cover 23 is formed in such a manner that two connected sub cover components 23*a*, 23*b* surround the exhaust pipe 13 and the flexible hose 15.

The operation of the above described fluid pump system will now be described.

When the fluid suction apparatus 50 is operated, it sucks gas in the inner space 25 of the cover body 21 through the suction port 21*d*. In accordance with the suction action, outside air current is generated in the cover 20 from a clearance between the hole 36 of the sub cover 23 and the flexible hose 15 toward the suction port 21*d* through the sub chamber 71, the communication hole 37 and the main chamber 70.

In case the process gas leaks from the connecting portion between the exhaust pipe 13 and the flexible hose 15 and from the vacuum pump 11 to a space in the cover 20, the leaked process gas is transferred by the above outside air current and is also collected by the fluid suction apparatus 50. Then the leaked process gas is sent to the exhaust gas treatment apparatus 51. For example, if the leaked process gas leaks from the main chamber 70 to the sub chamber 71 through the through hole 34, the fluid suction apparatus 50 collects the process gas by the outside air current so that the leakage of the process gas from the sub chamber 71 to the outside of the cover 20 is efficiently prevented.

The outside air introduced from the outside of the cover 20 to the sub chamber 71 through a clearance between hole 36 of the sub cover 23 and the flexible hose 15 is guided to the communication hole 37 by the inner wall surface 39 of the upper wall 38 of the sub cover 23 and is introduced into the main chamber 70. Incidentally, the rear ends 40, 41 of the first partition wall 30, for example, prevent gas introduced from the sub chamber 71 to the main chamber 70 through the communication hole 37 from flowing toward the through hole 34, that is, toward the first inner space 27*a*. The introduced gas is at least partially composed of the atmosphere.

The following advantageous effects are obtained from the preferred embodiment.

(1) The inside of the cover 20 is divided into the main chamber 70 for accommodating the vacuum pump 11 and the sub chamber 71. The flexible hose is delivered from the sub chamber 71 to the outside of the cover 20. Namely, the sub chamber 71 is arranged in a path, through which the process gas leaks from the main chamber 70 to the outside of the cover 20. Thus, the structure of the fluid pump system employs a multiple seal structure. Accordingly, even if the process gas in the main chamber 70 leaks through a clearance between the flexible hose 15 and the cover 20 (strictly, the through hole 34), the leaked process gas has only been transferred to the sub chamber 71, which is also defined in the same cover 20 as the main chamber 70. Namely, the leakage of the process gas from the main chamber 70 does not directly lead to the leakage of the process gas to the outside of the cover 20. As a result, in comparison to the single seal structure disclosed in the Unexamined Japanese Patent Publication No. 2002-130170, the multiple seal structure efficiently prevents the process gas from leaking outside the cover 20.

(2) The cover 20 includes the cover body 21 and the sub cover 23. The cover body 21 accommodates the vacuum pump 11. The sub cover 23 is fixedly connected to the outer surface 21*a* of the cover body 21 and defines the sub chamber 71 in the inner space 27. Namely, the cover 20 is divided near the sub chamber 71, through which the conduits (the exhaust pipe 13 and the flexible hose 15) are inserted. Accordingly, only if the sub cover 23 is detached from the cover body 21, the pipes become accessible.

(3) The connecting portion between the exhaust pipe 13 and the flexible hose 15 is provided in the inner space 27 of the sub cover 23. Accordingly, when the sub cover 23 is detached from the cover body 21, the connecting portion between the exhaust pipe 13 and the flexible hose 15 is exposed outside the cover body 21 so that the exhaust pipe 13 and the flexible hose 15 are easily connected with each other and detached from each other.

(4) The sub cover 23 is formed in such a manner that the two connected sub cover components 23*a*, 23*b* surround the conduits (the exhaust pipe 13 and the flexible hose 15). Accordingly, the flexible hose 15 need not be inserted from the end that is the connecting end of the flexible hose 15 to the exhaust pipe 13 and is opposite to the connecting end of the flexible hose 15 to the sub cover 23. Then, the sub cover 23 may easily be assembled to the cover body 21 after the piping has finished so that assembling of the fluid pump system improves. Namely, for example, when the sub cover 23 does not include a plurality of sub cover components, the flexible hose 15 need be inserted from the above described end so that assembling is complicated.

(5) The collecting means (the clearance between the hole 36 and the flexible hose 15, and the fluid suction apparatus 50) is provided in the cover 20 for collecting the process gas leaked from the connecting portion between the exhaust pipe 13 and the flexible hose 15 and from the vacuum pump 11. Accordingly, a large amount of process gas does not stay in the main chamber 70 and the sub chamber 71 so that the fluid pump system efficiently prevents the process gas from leaking outside the cover 20.

(6) The partition walls (the first and second partition walls 30, 21*f*, 21*g*) that define the main chamber 70 and the sub chamber 71 in the cover 20 respectively form the through hole 34 and the communication holes 37. The through hole 34 inserts the flexible hose 15. The communication holes 37 interconnect the sub chamber 71 with the main chamber 70 in addition to the through hole 34. Then, the collecting means collects gas in the sub chamber 71 from the communication holes 37 through the main chamber 70. Thus, the main chamber 70 functions as a path for collecting the gas in the sub chamber 71 so that the structure becomes simple in comparison to providing an exclusive collecting path. Additionally, the sub chamber 71 communicates with the main chamber 70 through the communication holes 37, which is separately formed from the through hole 34. Accordingly, the gas in the sub chamber 71 is efficiently collected without interference, which is, for example, gas leaked from the main chamber 70 to the sub chamber 71 through the through hole 34.

(7) The baffle boards (the rear ends 40, 41) are provided for the first partition wall 30 and are arranged between the opening of the through hole 34 and the openings of the respective communication holes 37 for interfering gas transferred between the openings. Accordingly, for example, the gas transferred from the sub chamber 71 to the main chamber 70 through the communication holes 37 is prevented from a vicious spiral, that is, from flowing back to the through hole 34 and leaking again to the sub chamber 71. As a result, the collecting means efficiently collects the process gas.

(8) The guide wall surface (the inner wall surface 39) is provided in the sub chamber 71 for guiding gas current from the sub chamber 71 to the main chamber 70 through the communication holes 37. Accordingly, the gas is smoothly transferred from the sub chamber 71 to the main chamber 70 through the communication holes 37 so that the collecting means efficiently collects the process gas.

(9) The vacuum pump 11 treats gas (gaseous body). The collecting means includes the fluid suction apparatus 50 that sucks the gas in the main chamber 70, that is, in the sub chamber 71, and the introducing passage (the clearance between the hole 36 and the flexible hose 15) for introducing the outside air into the cover 20. Then, the introducing passage is provided at the above described clearance between the cover 20 (strictly, the hole 36) and the flexible hose 15. Accordingly, the gas in the main chamber 70 and the sub chamber 71 is collected by the outside air current from the clearance toward the fluid suction apparatus 50. Thus, the clearance between the cover 20 and the flexible hose 15 is used as the introducing passage so that the outside air current is generated in the clearance from the outside of the cover 20 toward the inside of the cover 20. As a result, without any seal members at the clearance, the gas is efficiently prevented from leaking from the inside of the cover 20 to the outside of the cover 20.

(10) The vacuum pump 11 is used for the semiconductor manufacturing process. The vacuum pump 11 used in the semiconductor manufacturing process treats gas, which is avoided from being released into the atmosphere, such as flammable gas and toxic gas. Namely, the fluid pump system of the preferred embodiment is particularly efficient in view of ensuring safety in a space outside the cover 20.

(11) The connecting portion between the exhaust pipe 13 and the flexible hose 15 is provided in the main chamber 70. The inside of the connecting portion experiences gas pressure that is close to the discharge pressure of the vacuum pump 11 so that this connecting portion relatively tends to become a portion, through which the process gas leaks. Accordingly, in comparison to a connecting portion provided in the sub chamber 71 or outside the cover 20, the connecting portion efficiently prevents the process gas from leaking from the inside of the cover 20 to the outside of the cover 20.

(12) The fluid suction apparatus 50 is individually formed from the vacuum pump 11. Accordingly, the vacuum pump 11 need not vacuum gas in the cover 20, which is different from a vacuum pump that also serves as the fluid suction apparatus 50, that is, a vacuum pump functions to suck gas in the cover 20. As a result, the vacuum pump 11 is prevented from reducing the efficiency of vacuuming from the process chamber.

The present invention is not limited to the embodiment described above but may be modified into the following alternative embodiments.

In alternative embodiments to those of the preferred embodiment, the communication holes 37 are respectively arranged at distances from the inner wall surface 39 of the sub cover 23 in the second partition walls 21*f*, 21*g*.

In alternative embodiments to those of the preferred embodiment, the inner wall surface 39 need not be formed to guide the gas current. In other words, the inner wall surface 39 need not extend from the portion adjacent to the hole 36 of the sub cover 23 to the portion adjacent to the communication holes 37. For example, the inner wall surface 39 forms a vertical surface without inclining relative to the wall surfaces of the respective second partition walls 21*f*, 21*g*.

In alternative embodiments to those of the preferred embodiment, in the second partition walls 21*f*, 21*g*, the communication holes 37 are omitted. Also, a communication hole may be provided in the first partition wall 30 for introducing gas in the sub chamber 71 to the main chamber 70.

In alternative embodiments to those of the preferred embodiment, the sub cover 23 is not limited to include a plurality of sub cover components. In other words, the sub cover 23 may be a structure that only includes a single component, that is, a non-separated structure.

In alternative embodiments to those of the preferred embodiment, the connecting portion between the exhaust pipe 13 and the flexible hose 15 is provided in the inner space 25 of the cover body 21.

Figure 4:
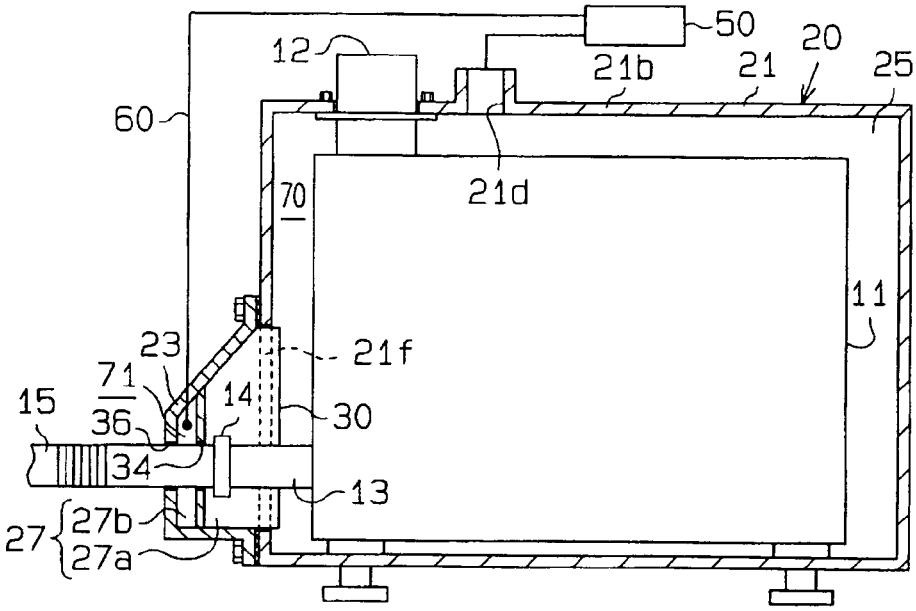
FIG. 4 is a longitudinal cross-sectional view of a fluid pump system according to an alternative embodiment of the present invention.

In alternative embodiments to those of the preferred embodiment, an exclusive collecting path is provided for introducing gas in the sub chamber 71 to the fluid suction apparatus 50 without passing through the main chamber 70. In this state, the structure is, for example, configured as shown in FIG. 4. Namely, a collecting path 60 is provided between the sub chamber 71 and the fluid suction apparatus 50 for interconnecting the sub chamber 71 and the fluid suction apparatus 50 without passing through the main chamber 70. Accordingly, in the second partition walls 21*f*, 21*g* (the right side second partition wall 21*f* only shown in FIG. 4), the communication holes 37 for interconnecting the sub chamber 71 and the inner space 25 of the cover body 21 are omitted.

Figure 5:
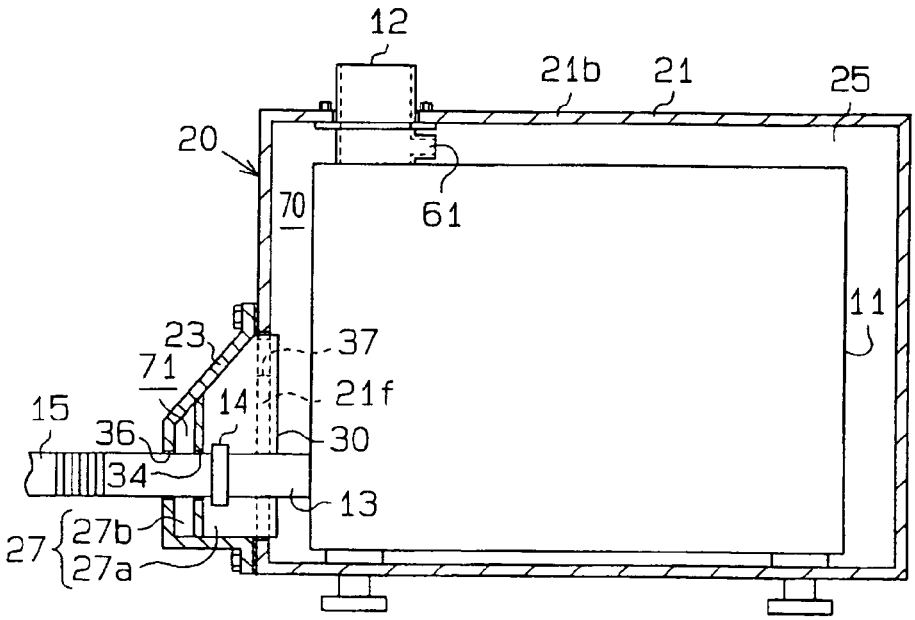
FIG. 5 is a longitudinal cross-sectional view of a fluid pump system according to another alternative embodiment of the present invention.

In alternative embodiments to those of the preferred embodiment, the vacuum pump 11 also serves as the suction means. In this state, for example, the structure is configured as shown in FIG. 5. Namely, a suction port 61 is provided at the proximal portion of the suction pipe 12 of the vacuum pump 11 in the inner space 25 of the cover body 21 for sucking and collecting gas in the inner space 25 to the vacuum pump 11. In this structure, the fluid suction apparatus 50 (the fluid suction apparatus other than the vacuum pump 11) for sucking gas in the inner space 25 to the vacuum pump 11 is omitted. The suction port 21*d* of the fluid suction apparatus 50 in the cover body 21 is also omitted. Namely, another individual fluid suction apparatus other than the vacuum pump 11 need not be provided so that the efficiency is improved for a space, while costs are reduced.

Incidentally, in the above structure, the vacuum pump 11 desirably does not vacuum flammable gas, such as the silane series gas, as the target fluid vacuumed to avoid the target fluid from catching fire in such a manner that the target fluid mixes with the atmosphere.

In alternative embodiments to those of the preferred embodiment, the collecting means need not be provided in the cover 20 for collecting the process gas that is leaked from the connecting portion between the exhaust pipe 13 and the flexible hose 15 and from the vacuum pump 11 to the main chamber 70 and the sub chamber 71. For example, the fluid suction apparatus 50 need not be provided, and the vacuum pump 11 need not function to collect gas in the inner space 25 of the cover body 21. In this state, a seal member is desirably provided for shutting communication between the main chamber 70 and the outside of the cover 20 through the clearances between the holes (the hole 36 of the sub cover 23 and the through hole 34) and the conduits (the exhaust pipe 13 and the flexible hose 15). Additionally, a communication hole (for example, the communication hole 37) for interconnecting the main chamber 70 and the sub chamber 71 is desirably omitted to prevent the process gas from leaking from the main chamber 70 to the sub chamber 71.

In alternative embodiments to those of the preferred embodiment, a plurality of the sub chambers 71 is provided in the cover 20.

In alternative embodiments to those of the preferred embodiment, the connecting portion between the exhaust pipe 13 and the flexible hose 15 is provided in the sub chamber 71 or is provided outside the cover 20. Even so, the process gas is prevented from leaking outside the cover 20.

In alternative embodiments to those of the preferred embodiment, the suction pipe 12 extends from the sub chamber 71 to the outside of the cover 20.

In the above preferred embodiment, the sub cover 23 that defines the inner space 27 outside the cover body 21 is fixedly connected to the cover body 21. In alternative embodiments to those of the preferred embodiment, for example, the cover body 21 is elongated forward to expand the inner space 25 forward, and the inner space 25 is divided into a main chamber and a sub chamber. Then, the vacuum pump 11 is accommodated in the main chamber, while the conduits (the exhaust pipe 13 and the flexible hose 15) extend from the sub chamber to the outside of the cover body 21.

In alternative embodiments to those of the preferred embodiment, the vacuum pump 11 is used for a process other than the semiconductor manufacturing process.

In alternative embodiments to those of the preferred embodiment, the vacuum pump 11 is a type other than the roots type. Also, a fluid pump other than the vacuum pump is employed.

In alternative embodiments to those of the preferred embodiment, a fluid pump treats liquid (liquid body).

In alternative embodiments to those of the preferred embodiment, the fluid pump system is not limited to be arranged in the atmosphere but may be arranged in fluid other than the atmosphere.

Therefore, the present examples and embodiments are to be considered as illustrative and not restrictive, and the invention is not to be limited to the details given herein but may be modified within the scope of the appended claims.

What is claimed is:

1. A fluid pump system comprising:

a cover, an inside of which is divided into a main chamber and a sub chamber;

a fluid pump accommodated in the main chamber;

a conduit extending from the fluid pump to an outside of the cover through the sub chamber; and a collecting means for collecting fluid that is leaked from the fluid pump and/or the conduit into the main chamber and the sub chamber in the cover;

wherein the main chamber and the sub chamber are defined by a partition wall in the cover, the partition wall forming:

a through hole through which the conduit extends; and a communication hole interconnecting the sub chamber and the main chamber in addition to the through hole, the collecting means collecting the fluid in the sub chamber through the communication hole and the main chamber.

2. The fluid pump system according to claim 1, wherein the partition wall has a baffle board that protrudes toward the main chamber between an opening of the through hole and an opening of the communication hole for interfering the fluid to transfer therebetween.

3. The fluid pump system according to claim 1, further comprising:

a guide wall surface provided in the sub chamber for guiding the fluid to flow from the sub chamber toward the main chamber through the communication hole.

4. The fluid pump system according to claim 3, wherein the guide wall surface extends from the adjacent through hole to the adjacent communication hole.

5. The fluid pump system according to claim 1, wherein the fluid pump treats gas, the collecting means includes:

a suction means for sucking the gas in the cover; and an introducing passage provided at a clearance between the conduit and the cover for introducing outside air into the cover.

6. The fluid pump system according to claim 5, wherein the fluid pump also serves as the suction means.

7. The fluid pump system according to claim 5, wherein the suction means is separately provided from the fluid pump.

8. The fluid pump system according to claim 5, wherein the suction means directly sucks the gas in the main chamber.

9. The fluid pump system according to claim 5, wherein the suction means directly sucks the gas in the sub chamber.

10. The fluid pump system according to claim 1, wherein the fluid pump is a vacuum pump for use in a semiconductor manufacturing process.

11. The fluid pump system according to claim 10, wherein the vacuum pump is a roots type.

12. The fluid pump system according to claim 1, wherein the cover includes:

a cover body accommodating the fluid pump; and a sub cover fixedly connected to an outer surface of the cover body while the sub cover defines an inner space inside, the inner space including the sub chamber.

13. The fluid pump system according to claim 12, wherein the sub cover includes a plurality of sub cover components, which are connected with one another so as to surround the conduit.

14. The fluid pump system according to claim 12, wherein the conduit includes:

a first conduit component extending from the fluid pump; and a second conduit component extending from the outside of the cover to connect the first conduit component at a connecting portion in the inner space of the sub cover.

15. A fluid pump system comprising:

a cover, an inside of which is divided into a main chamber and a sub chamber;

a fluid pump accommodated in the main chamber;

a conduit extending from the fluid pump to an outside of the cover through the sub chamber for exhausting fluid of the fluid pump;

a collecting means for collecting the fluid that is leaked from the fluid pump and/or the conduit into the main chamber and the sub chamber in the cover; wherein the fluid pump treats gas, the collecting means including:

a suction means for sucking the gas in the cover; and an introducing passage provided at a clearance between the conduit and the cover for introducing outside air into the cover.

* * * * *